United States Patent [19]

Pedersen et al.

[11] 4,072,250

[45] Feb. 7, 1978

[54] APPARATUS FOR PLUGGING HOLES IN AN ELECTRIC SMELTING FURNACE OR THE LIKE

[75] Inventors: Thor Pedersen, Vagsbygd; Aksel Erik Kristiansen, Oslo, both of Norway

[73] Assignee: Elkem-Spigerverket A/S, Oslo, Norway

[21] Appl. No.: 705,573

[22] Filed: July 15, 1976

Related U.S. Application Data

[63] Continuation-in-part of Ser. No. 563,200, March 28, 1975.

[51] Int. Cl.[2] ..... C21B 7 /12

[52] U.S. Cl. ..... 222/326; 222/567; 266/273

[58] Field of Search ..... 266/42, 273; 222/326, 222/327, 325, 386, 388, 567; 16/173, 176; 220/242, 243

[56] References Cited

U.S. PATENT DOCUMENTS

| | | | |
|---|---|---|---|
| 1,889,433 | 11/1932 | Brosius | 266/42 |
| 2,111,582 | 3/1938 | Crewe | 222/327 |
| 2,169,604 | 8/1939 | Fraser et al. | 266/42 |
| 2,270,256 | 1/1942 | Brosius | 266/42 |
| 2,853,290 | 9/1958 | Morgan | 266/42 |
| 3,682,456 | 8/1972 | Berczynski | 266/42 |

*Primary Examiner*—Drayton E. Hoffman
*Assistant Examiner*—David A. Scherbel
*Attorney, Agent, or Firm*—Eyre, Mann, Lucas & Just

[57] ABSTRACT

An apparatus for plugging holes in an electric smelting furnace or the like is disclosed. The apparatus comprises first and second tubular members, the second being adapted to be secured to the first by means of two assemblies mounted exterior of the tubes each of which may serve as either a release or a pivotal element about which the second tubular member may be rotated to facilitate loading and/or cleaning of either tubular member. A piston is provided which travels substantially the longitudinal extent of the first tubular member to extrude, under pressure, a material suitable for plugging a hole.

2 Claims, 1 Drawing Figure

APPARATUS FOR PLUGGING HOLES IN AN ELECTRIC SMELTING FURNACE OR THE LIKE

Figure 1:
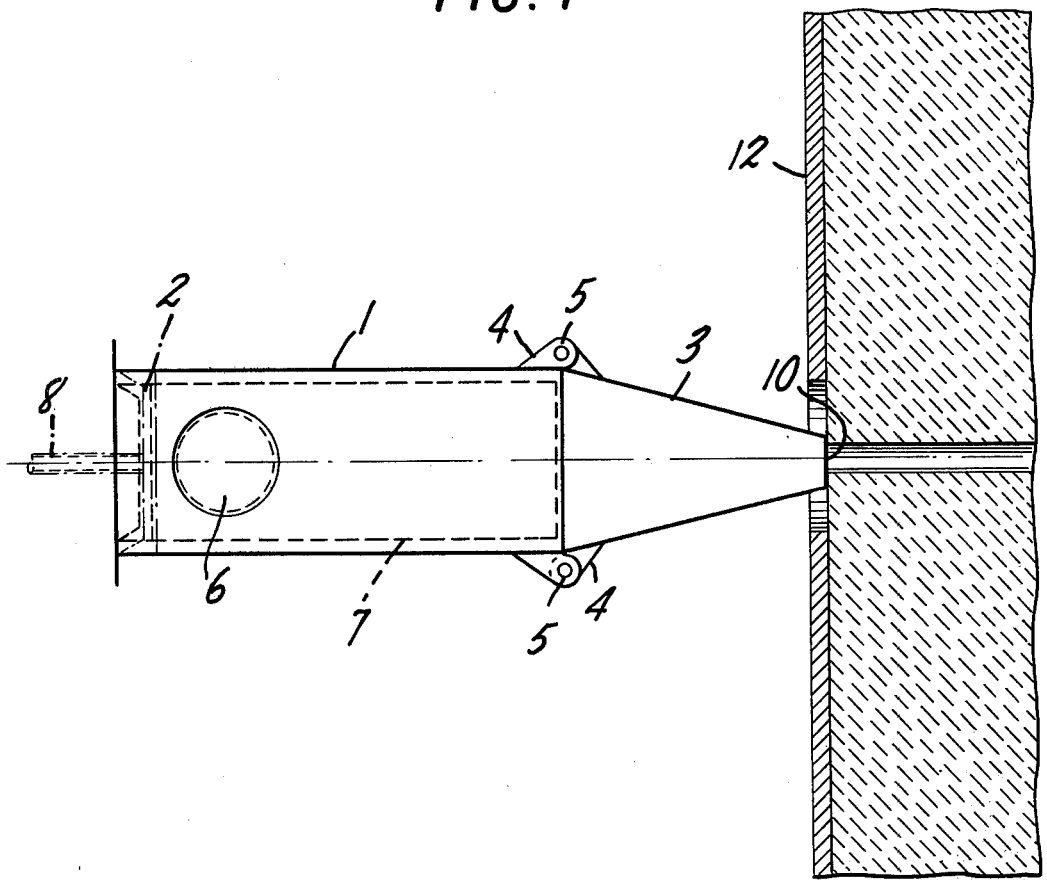

The present application is a continuation-in-part of application Ser. No. 563,200 filed Mar. 28, 1975.

The present invention relates to an apparatus employed in tapping procedures in electric smelting furnaces and more particularly, for plugging tapping holes therein.

It is well known in the smelting industry to employ a suitable material such as clay, paste, or the like for plugging tapping holes which may be conveniently provided at various locations in the furnace. Typically employed are so-called tapping guns which may consist of a tube with a piston operated by a compressor or similar arrangement. Operating pressures on the piston typically are in the range 7–14 kg/cm$^2$. Pressures on the plugging clay or past piston may be as great as 28 kg/cm$^2$, the pressure requirement being simultaneously a function of the type of plug paste employed and the smelting product. As will be apparent, the plug paste is ejected from the gun with great force.

Known tapping gun apparatus are so designed as to require filling of the tube through a closable hatch on the tube, characteristically located over and slightly in front of the rearmost or completely retracted position of the piston. The size of the port associated with the typical hatch is, of necessity, of rather small diameter relatively to the volume of material which is to be forced therethrough, which volume generally ranges from about 30–50 liters. Thus, it is seen that a laborious, tedious and time consuming effort is involved, particularly in view of the necessity to manually operate the piston many times in order to fill the tube. There is also an inherent operator risk in this procedure as demonstrated by the frequency with which individuals actually sustain injuries to their hands during the course thereof.

In the typical arrangement hereinabove described, there is yet another drawback which has, again, occasioned time consuming, laborious and tedious effort. As will be appreciated readily, cleaning of such apparatus has been troublesome. In fact, in many instances attempts at cleaning have not been altogether successful, there remaining a residual of hardened or compacted paste which serves to degrade performance of the apparatus during the course of subsequent tapping or plugging operations.

A further design characteristic of known apparatus has been the relatively elaborate means for securing the typical tapered portion of such apparatus through which portion the plug paste is propelled. In that such portion, characteristically referred to as a mouthpiece or portion and generally fashioned in conical configuration, has been considered heretofore as permanently fixed to the remainder of the gun, there has typically been provided an arrangement of at least four heavy nut and bolt assemblies. Permanent, in this sense, is a relative term since the mouthpiece or portion is subject to wear and occasional damage during the ordinary course of operation of the gun. Occasionally the mouthpiece is partially destroyed by liquid metal.

Accordingly, it is a general object of the present invention to provide an improved apparatus for plugging tapping holes in a furnace having design features which facilitate safe loading, efficient cleaning, maintenance and repair and further, giving rise to improved operating characteristics.

With this object in view, there is provided apparatus for plugging holes in an electric smelting furnace or the like comprising a tubular member having accessible openings at the longitudinal extremes thereof, a piston operatively associated therewith being sized and adapted to be inserted therein and displaced along the longitudinal axis therof, a hatch formed in the tubular member the hatch being appropriately dimensioned to at least permit visual inspection of the contents of the tubular member, a second, generally conical member having accessible openings at the longitudinal extremes thereof, a first accessible opening being dimensioned to be urged into intimate contact with the periphery of one of the accessible openings of the tubular member and a second accessible opening being dimensioned according as the requirements as predefined by the size of a hole to be plugged, and means exterior of the tubes and having a first and a second portion for securing the tubular member to the conical member the means being adapted to permit the conical member to be released at a first portion of the securing means and pivoted about a second portion of the securing means whereby the tubular members are fully open.

Preferably, the securing means are constituted by substantially identical assemblies each of which may comprise, for example, a hinge and a taper pin adapted to be releasably inserted therein.

The hatch may serve the dual purposes of permitting visual inspection of the contents of the main body or tubular member of the apparatus, and, if appropriately sized, serving as an alternative entry port for the plugging paste in rare instances, as necessary.

Desirably, a cannister-like reservoir or container is provided appropriately sized to be loaded into the main body and extracted upon exhaustion of the supply of plugging paste or other material contained therein. In this arrangement, the piston head is modified to be appropriately dimensioned for travel through a tubular chamber having a smaller diameter bore.

These and other aspects of the present invention will now be more fully described with reference to the single drawing FIGURE presented by way of example only, and in which is shown a somewhat schematic top view of an embodiment of the present invention.

Referring now to the FIGURE, there is shown a main body or tubular member 1, the chamber or bore of which is adapted to receive a piston 2 and permit its travel substantially the longitudinal extent thereof. The piston 2, shown in its retracted or seated position, may be correspondingly adapted at its outer diameter to sealingly engage the inner diameter of the bore along the extent of its travel therethrough. A mouthpiece or portion 3 shown as having a generally conical configuration is positioned such that the periphery of its larger diameter opening sealingly engages the periphery of an opening at the opposite longitudinal extreme of the main body or tubular member 1 from that into which is received the piston 2. The mouthpiece 3 is provided at its opposite longitudinal extreme with an opening preferably sized to correspond to the diameter of a hole 10 of an electric smelting furnace pot 12 to be plugged.

Securing of the generally conical tubular member 3 into the position shown is accomplished by means of hinge assemblies 4, 5 shown as substantially identical leaf member and bolt arrangements. The bolts 5 are taper pins which are not in threaded engagement with either leaf member so that they can be easily removed by one or more sharp blows.

From an examination of the drawing FIGURE it will be apparent that the hinge assemblies 4, 5 additionally serve the purpose of allowing the mouthpiece 3 to be pivotally disengaged from the tubular member 1. A given taper pin 5 may be readily removed while its counterpart is maintained in its associated leaf 4. It is important to note that corresponding leaf members 4 and 4' on the tubular portion of the conical portion respectively are spaced approximately 180° away from each other and are located exteriorly of the members so that (a) a taper pin can be removed from either hinge simply by a series of sharp blows and then the mouthpiece can be swung in either direction and (b) when the mouthpiece is so swung the entire cross sectional area of the tubular member is exposed and accessible and there is no interference or obstruction from the mouthpiece. Exposure of the entire cross sectional area of the tubular member is very important to proper loading of clay in the tubular member and this is especially true when using cannister 7.

In addition to the capability to swing the mouthpiece to either side because of the taper pins 5, the apparatus of the present invention has the additional highly desirable feature of easy replacement of the mouthpiece. By simply knocking out the two taper pins 5, the mouthpiece 3 can be easily and quickly replaced. (It is pointed out that for safety reasons additional quick-release latches may sometimes be employed in addition to the hinge members and the use of such quick-release latches is within the purview of the present invention.) This feature is especially important as a safety feature since the mouthpiece can be easily replaced if it is damaged by molten metal and can be replaced quickly enough to minimize the amount of molten metal which pours onto the furnace floor and creates a serious safety hazard as well as an economically devastating condition. In contrast to this, mouthpieces on conventional tapping guns are bolted in place and not easily or quickly removable and it is thus necessary to maintain another entire assembly in reserve in the event that the mouthpiece of the operating one is damaged. It is pointed out that these tapping guns are not small hand operated pieces of equipment but are over ten feet in length (usually around 15 feet) and it is necessary to use machinery to move them about. Thus, the apparatus of the present invention presents substantial safety, economical and ease of manufacturing operations in permitting easy replacement of the mouthpiece.

In the preferred embodiment a prepacked cylinder or cartridge 7, preferably of a material such as plastic, cardboard or the like may be placed into the tubular member or main body 1. The outer diameter of the cartridge 7 should be somewhat smaller than the inner diameter of the tubular member 1 as will be apparent. The diameter of the head of the piston 2 is sized so that it will pass freely through the tubular member 1, or alternatively, the cylinder 7.

In plugging operations the apparatus is connected to a source of compressed air or a hydraulic cylinder (not shown) or other appropriate actuating means by means of a piston rod 8. The piston 2 is caused to be propelled forward through the tubular member 1 to propel the plugging material through the opening in mouth portion 3 whereby a plugging operation is completed.

In the filling operation, the mouthpiece 3 is released from one of the hinges by removal of an associated taper pin 5 by striking it with several sharp blows. The mouthpiece 3 may then be pivoted about the opposing assembly 4, 5 to completely expose the entire cross section of the tubular member and allow complete or partial filling of the tubular member 1 or, alternatively, the insertion of a cannister 7 therein.

In a cleaning operation, the mouthpiece 3 is released from one side and pivoted in precisely the same manner as that required for filling operation. Residual material may then be pushed backward by insertion of an appropriate rod through the smaller diameter accessible opening in the mouthpiece 3. It will be apparent that other techniques for cleaning might be employed in that there are two accessible openings. Cleaning of the tubular member 1 is also facilitated by the fact that it is completely accessible by swinging the mouthpiece.

It will be understood that the claims are intended to cover all changes and modifications of the preferred embodiment of the invention, herein chosen for the purpose of illustration, which do not constitute departures from the spirit and scope of the invention.

What is claimed is:

1. Apparatus for plugging holes in an electric smelting furnace or the like comprising a tubular member open at a first end thereof, a piston operatively associated with said tubular member being sized and adapted to be inserted therein and displaced along the longitudinal axis thereof, a second, generally conical member having accessible openings at the axial extremes thereof, a first accessible opening being dimensioned to be urged into contact with the opening of the first end of said tubular member and a second accessible opening being dimensioned according to a predetermined size based on the size of a hole to be plugged, and means joining said tubular member to said conical member with the said first accessible opening and said opening of the first end being in register, said means comprising two hinge means spaced approximately 180° from each other, each said hinge means comprising cooperating leaf members joined by a taper pin, one leaf of each said hinge means being affixed to the tubular member and being mounted on the exterior thereof and the other said leaf member being affixed to the conical member and being mounted on the exterior thereof, each said taper pin being free of threaded engagement with the hinge members and being removable upon the application of one or more sharp blows, the axes of said two taper pins being substantially parallel to each other said axes being substantially vertical, removal of one or the other of said taper pins permitting the conical member to be rotated in a horizontal direction either to the left or to the right about the vertical axis of the other said taper pin to a point where the entire cross-sectional area of the said opening of the first end of the tubular member is exposed and unobstructed by the conical member and removal of both said taper pins permitting separation of the said conical member from the said tubular member.

2. Apparatus as claimed in claim 1 and further comprising a generally cylindrical replaceable member dimensioned and adapted to be inserted into the exposed and unobstructed end of said tubular member at least when said conical member is rotated upon one or the other of its hinge members, said replaceable member containing a material for plugging a hole and being further adapted to receive said piston therein and to allow travel of said piston therethrough.

* * * * *